United States Patent [19]

Irwin

[11] 3,990,346

[45] Nov. 9, 1976

[54] GAS LOCKED FIREARM

[76] Inventor: Robert M. Irwin, 5313 Gypsy Ave., Las Vegas, Nev. 89107

[22] Filed: Feb. 18, 1975

[21] Appl. No.: 550,275

[52] U.S. Cl. ..... 89/180; 89/191 R
[51] Int. Cl.[2] ..... F41D 3/00; F41D 5/08
[58] Field of Search ..... 89/180, 191 A, 191, 89/193

[56] References Cited

UNITED STATES PATENTS

| | | | |
|---|---|---|---|
| 2,865,256 | 12/1958 | Marsh | 89/191 |
| 3,261,264 | 7/1966 | Wilson | 89/191 A |

*Primary Examiner*—David H. Brown
*Attorney, Agent, or Firm*—Jerry R. Seiler

[57] ABSTRACT

An improved gas locked firearm using expanding gases to force a bullet through a barrel in which a portion of said gases are diverted through a gas port communicating with a gas locking chamber adjacent said barrel which chamber is formed between said barrel and an extension arm of the bolt or breech block extending forward therefrom a distance along the rear portion of the barrel and forming an elongated gas chamber between a shoulder on the rear of the barrel and a plate extending from said breech block extension in a manner to trap the expanding gases between said barrel shoulder and said plate to lock the breech block in a forward position while gas pressure exists in the barrel and provided with additional gas ports in the breech block extension and plate to vent remaining gases as the firearm action cycles.

8 Claims, 3 Drawing Figures

GAS LOCKED FIREARM

BACKGROUND OF THE INVENTION

Heretofore in self-loading and automatic or semiautomatic firearms designed to fire high-powered ammunition it has been necessary to utilize a mechanically locked breech. Such systems are present in most gas or recoil operated firearms and require somewhat complicated breech and locking mechanisms in which the tolerances of the various components are critical. Not only are such weapons more difficult and expensive to manufacture but because of the close tolerances wear on the parts and subsequent replacement is often required. In addition, because of the multiplicity of the components, such weapons are quite heavy and thus somewhat burdensome for an operator to carry and handle.

A number of simplified self-loading and automatic or semi-automatic weapons have been proposed in attempts to obviate the disadvantages of mechanically locked breech operated weapons known as blowback firearms, which because of their ease of maintenance, relatively few parts and lower cost, have been used extensively for military purposes. However, such weapons have necessitated the use of relatively low-powered ammunition since the gas expanding in the firing chamber cannot reach great enough pressure before the action of the rearward moving breech results in significant pressure drop in the firing chamber. Accordingly, the velocity of the bullets fired from such weapons is relatively low and concomitantly the accuracy is significantly impaired by the heavy breech block being in motion compared to weapons incorporating mechanically locked breeches.

In an attempt to overcome this problem, mechanically delayed blowback weapons have been proposed which incorporate roller locks or similar devices. However, such weapons have proven extremely expensive to manufacture because of very close tolerances required in the action as well the complicated multi-piece breech blocks needed for the delay system. Gas operated blowback devices for damping or delaying recoil of the breech or bolt have been proposed, for example, in U.S. Pat. Nos. 1,834,021 and 3,261,264. However, such devices do not provide for adequate damping of the breech block or bolt during the delayed recoil. Moreover, these prior art devices do not adequately provide for venting of the hot gases from the locking chamber. Unless these gases are adequately removed, the weapon may soon overheat to an extent of malfunction as well as causing possible permanent deterioration of the components involved.

SUMMARY OF THE INVENTION

It is an object of the present invention to obviate the above-noted disadvantages by incorporating a blowback action in which the bolt is temporarily locked in its forward position immediately after firing and until the bullet has left the barrel. It is also an object of the invention to provide for a gas breech or bolt locking system in a blowback action device in which a vented locking chamber yields improved regulation of the cyclic rate. It is also an object to provide a weapon having an improved design whereby the malfunction and deterioration of the components of the blowback and gas locking operation are minimized. Utilizing such a concept, high powered ammunition can be fired without the necessity of incorporating mechanically locked breeches or the requirement of unduly heavy bolts or close tolerance parts. These as well as other advantages will be evident from the following description.

DETAILED DESCRIPTION OF THE INVENTION

Figure 1:
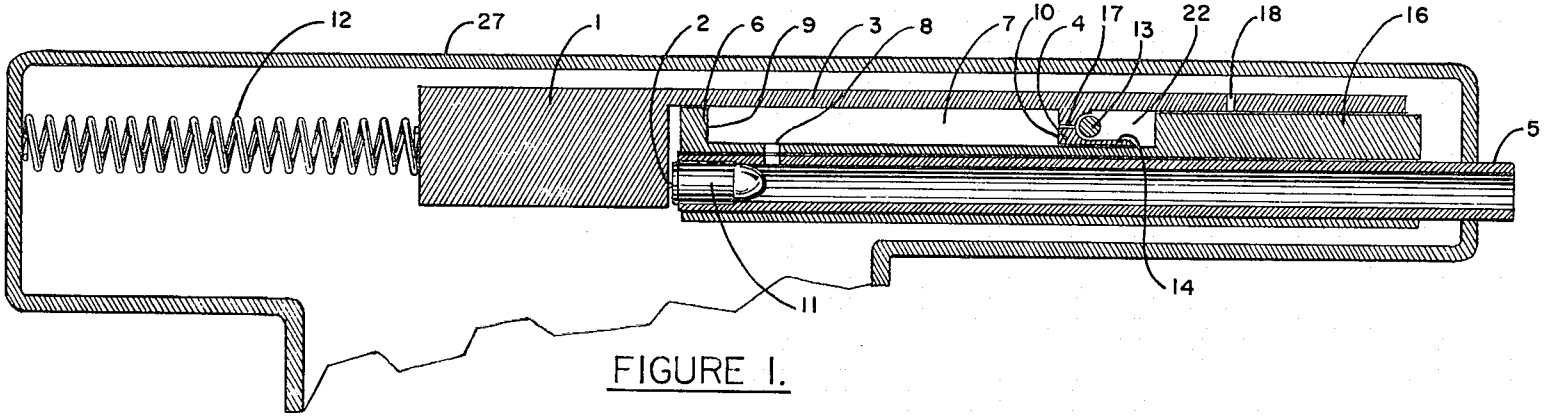
FIG. 1 is a sectional elevation illustrating the components and features of the gas locking blowback weapon of the invention at the instant of firing a cartridge in the chamber.
Figure 3:
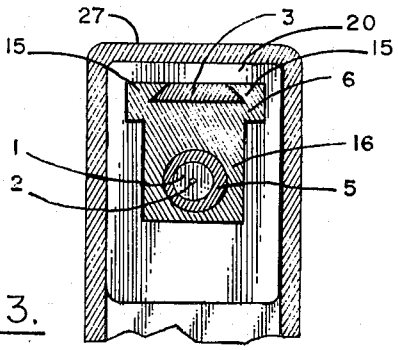
FIG. 3 is a section taken along line A—A of FIG. 2.

Referring now to FIG. 1, the invention illustrating a gas lock blowback operation. The components are shown with a cartridge in the firing chamber at the moment when the firing pin of a forwardly moving bolt 1 strikes the cartridge. Bolt 1 has a fixed firing pin 2 on the forward surface thereof, and a forwardly extending arm 3 and plate 4. Barrel housing 16 includes shoulder 6 at the upper back portion and which extends into gas locking chamber 7 at its rearward end with forward shoulder surface 9 defining the back of the gas locking chamber. Barrel housing 16 may or may not be constructed as an integral part of the barrel so that they may be cast in one-piece construction rather than separately as shown. As illustrated in FIG. 3, barrel housing 16 is provided with a slot 20 extending along its top surface and a pair of rims 15 having interior slanted surfaces to form a wedge shaped slot for slidably receiving arm 3 of bolt 1. The slot extends along the shoulder and may also be provided on the forward barrel housing, i.e., forward of the gas locking chamber so that the bolt arm may be received therein substantially or entirely along its length. The bolt arm is, of course, shaped to slidably fit into the slot. The purpose for this feature is to prevent bolt arm 3 from being driven upwardly against receiver 27 when the gases are vented into the locking chamber 7 as will be more fully discussed hereinafter. Instead of the wedge or slanted opposing interior surfaces of rims 15 and arm 3, the slot may have, for example, a flattened rectangular shape or the like defined between rims which extend upwardly and inwardly with the bolt arm having the same cross sectional shape of the slot and with the rims extending at least partially over the bolt arm to prevent its upward movement. Without such a feature, the bolt arm could be driven upwardly becoming warped and impinging on the receiver. Any equivalent means for achieving the same advantage may be used. The receiver is shown schematically for illustration only. For example, there will normally be no substantial spacing between the upper arm surface and the receiver in order to reduce the size and bulkiness of the weapon. The shape of the receiver may also be any varied or modified design as desired. Moreover, there will be means, not shown, for securing the components within the receiver.

The bolt arm 3 is also provided with a vented plate 4. This member has a vent 17 extending entirely therethrough and a lip 14 extending forwardly from the plate. A groove or cavity 22 is formed on the forward portion of the vented plate. Extending across the cavity is a cross pin 13 secured to the receiver or barrel housing and received and seated in the cavity so that lip 14 underlies and engages the pin when the plate and bolt are in the forwardmost position shown in FIG. 1. This feature provides additional means for preventing the bolt arm from being forced upwardly when gas expands rapidly in the locking chamber 7. The purpose of vent 17 is to allow gas in the locking chamber to bleed or slowly pass through the vent at the end of the firing cycle as shown in FIG. 3.

The barrel is provided with a gas port 8 which communicates with the barrel interior and locking chamber 7 defined between the forward extending bolt arm 3, the upper exterior barrel surface, and between the forward surface 9 of shoulder 6 and rear surface 10 of plate 4. Port 8 is preferably located immediately forward of the cartridge, i.e., more than one cartridge length but less than 2 cartridge lengths from the end of the firing chamber. The close proximity of the port to the cartridge or firing chamber end is to provide for entry of gas from the fired cartridge through the port and into the gas locking chamber 7 as soon as possible.

Figure 2:
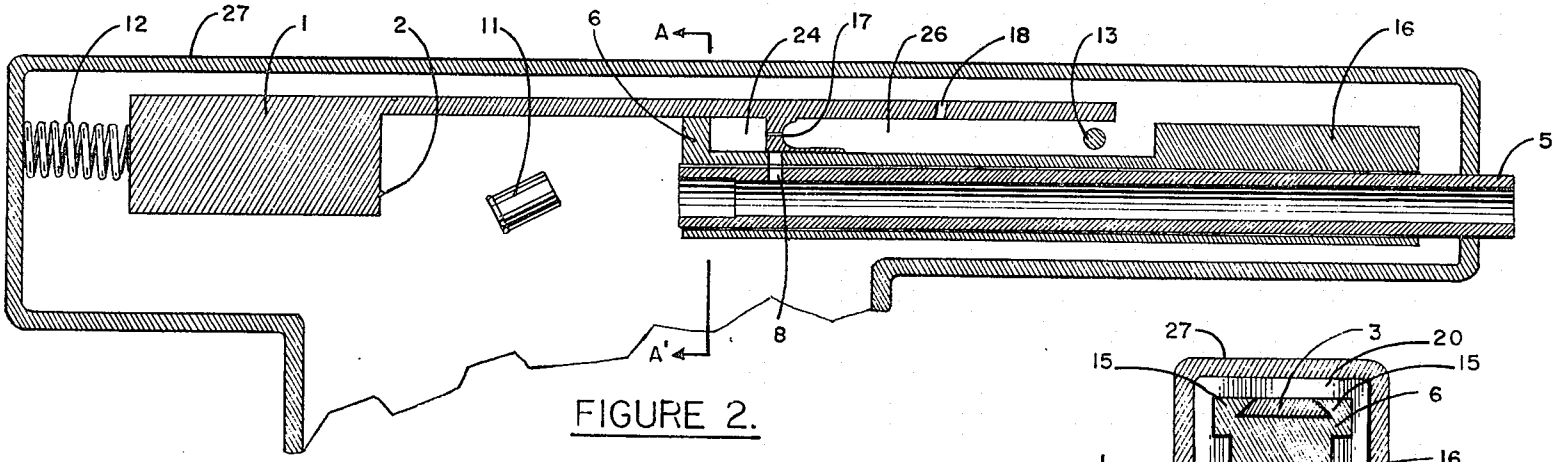
FIG. 2 is a sectional elevation of the components of FIG. 1 after the shell has left the weapon and at the termination of bolt recoil.

In operation, a cartridge located in firing chamber 11 will be fired when firing pin 2 of bolt 1 strikes the head of the cartridge case in response to trigger pull which releases the bolt from the rearward position. As the bolt moves forward, arm 3 advances and slides along slot 20 on barrel shoulder 6. The bolt position shown in FIG. 1 is in the forward position as it strikes a cartridge during the firing cycle and at the same time lip 14 on plate 4 locks under cross pin 13 in order to prevent upward movement of arm 3 during peak gas pressure. On firing, the bolt will tend to be forced rearwardly by the cartridge case, opening the breech, which immediately after firing would be premature. However, there will be sufficient initial delay of the bolt rearward movement due to its weight as well as recoil spring 12 urging the bolt in its forward position until the bullet has cleared gas port 8. Gas from the exploded cartridge charge enters locking chamber 7 and against surface 10 of the plate 4. This high pressure urges the plate 4 in the forward position and thus arm 3 maintains the bolt 1 in a locked forward position until the projectile has left the muzzle allowing the gas pressure to drop. When the gas pressure in the barrel and locking chamber has decreased sufficiently, the rearward momentum of the cartridge case against the forward bolt surface causes the bolt to be driven rearwardly. As the bolt nears the rearward position as shown in FIG. 2, plate 4 passes over and closes gas port 8 trapping and compressing the remaining gas in the rear portion 24 of the gas locking chamber to cushion the movement of the bolt 1 as it reaches the end of its remaining rearward travel. Thus, the gas present in locking chamber portion 24 acts as a buffer or air valve in retarding the blowback action and preventing the bolt from slamming to its fully recoiled position. Vent 17 which had been blocked closed with the bolt in its forward position (FIG. 1) by cross pin 13 is now exposed and allows this remaining gas to vent slowly into chamber portion 26 (FIG. 2) as the bolt comes to rest at the end of its cycle. Port 18 in arm 3 now communicates with the chamber position thereby venting any remaining gases into the atmosphere. This provides for fully venting the hot gases from the locking chamber which also improves the cooling of the weapon during the firing cycle.

It will be appreciated that the use of the gas locking chambers, as described hereinabove, will yield weapons which are relatively easy to manufacture, have few assembly parts, and are simple to break down and repair, and at the same time utilize high-powered cartridges without the necessity of complicated mechanical breech assemblies or unduly heavy bolts or barrels. Again, any type of trigger or recoil spring assembly, as well as other components, may be incorporated in to such weapons, as will be appreciated by those skilled in the art. Further, the concept herein may be used in rifles, pistols, shotguns, submachine guns, machine guns and automatic cannon of various sorts.

I claim:

1. In a blowback action firearm having a bolt slidably disposed in a receiver, the improvement comprising a bolt having an arm extending forwardly thereof and a plate attached to said arm and extending to an upper barrel wall and having a vent therethrough communicating with a gas locking chamber, a barrel having an upwardly extending rear shoulder and a port through the upper barrel wall which port communicates with a gas locking chamber, and a gas locking chamber defined between said plate, barrel shoulder, upper barrel wall and arm, whereby expanding gas from a fired cartridge is directed through said port and into said gas locking chamber for temporarily preventing rearward recoil of said bolt, and during recoil gas in said locking chamber is vented through said vent in said plate.

2. The firearm of claim 1 wherein said port is located immediately forward of a firing chamber adjacent the bolt and less than two cartridge lengths from a forward bolt surface.

3. The firearm of claim 1 wherein said shoulder has a slot therein for slidably receiving said arm and preventing it from being displaced upwardly from gas pressure in said locking chamber.

4. The firearm of claim 1 including a port on said arm which port is out of communication with said locking chamber when said bolt is fully forward and is in communication with said chamber when said bolt is in a recoil position for venting gases from said chamber during recoil.

5. The firearm of claim 1 wherein said barrel port and said plate are disposed so that during recoil of said bolt, said plate closes said port whereby gases are temporarily trapped and compressed in a portion of said gas locking chamber to buffer said bolt recoil.

6. The firearm of claim 1 including means for preventing premature escape of gas from said locking chamber prior to recoil of said bolt.

7. The firearm of claim 4 wherein said means comprises a stationary member blocking said vent when said bolt is fully forward.

8. The firearm of claim 7 including means on said plate engaging said stationary member when said bolt is fully forward.

* * * * *